US010131144B2

(12) United States Patent
Kakiuchi

(10) Patent No.: US 10,131,144 B2
(45) Date of Patent: Nov. 20, 2018

(54) LIQUID JET APPARATUS AND METHOD FOR MANUFACTURING LIQUID JET APPARATUS

(71) Applicant: Brother Kogyo Kabushiki Kaisha, Nagoya-shi, Aichi-ken (JP)

(72) Inventor: Toru Kakiuchi, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/671,582

(22) Filed: Aug. 8, 2017

(65) Prior Publication Data

US 2018/0079211 A1 Mar. 22, 2018

Related U.S. Application Data

(63) Continuation of application No. 14/757,493, filed on Dec. 23, 2015, now Pat. No. 9,757,943.

(30) Foreign Application Priority Data

Dec. 26, 2014 (JP) ..... 2014-264176

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1628* (2013.01); *B41J 2/1629* (2013.01);
(Continued)

(58) Field of Classification Search
CPC ..... B41J 2/14233; B41J 2/161; B41J 2/1628; B41J 2/1629; B41J 2/1631; B41J 2/1646;
(Continued)

(56) References Cited

U.S. PATENT DOCUMENTS 8,390,179 B2 * 3/2013 Harigai ..... C23C 14/0021 252/62.9 PZ
9,144,977 B2 9/2015 Hirai et al.
(Continued)

FOREIGN PATENT DOCUMENTS

JP 2005-349568 A 12/2005
JP 2013-158909 A 8/2013

OTHER PUBLICATIONS

Apr. 26, 2017—(US) Notice of Allowance—U.S. Appl. No. 14/757,493.

*Primary Examiner* — Juanita D Jackson
(74) *Attorney, Agent, or Firm* — Banner & Witcoff, Ltd.

(57) ABSTRACT

There is provided a liquid jet apparatus including a channel substrate having a plurality of pressure chambers and a film covering the plurality of pressure chambers, a piezoelectric layer, a plurality of individual electrodes, a common electrode, and a trace extending from one of the plurality of individual electrodes to pass through between two adjacent individual electrodes of the plurality of individual electrodes. An opening of the piezoelectric layer is provided between the two adjacent individual electrodes, and a metallic film is formed to cover the trace in such an area of the trace as to overlap with the opening positioned between the two adjacent individual electrodes.

9 Claims, 10 Drawing Sheets

(52) U.S. Cl.
CPC ..... *B41J 2/1631* (2013.01); *B41J 2/1646* (2013.01); *B41J 2002/1425* (2013.01); *B41J 2002/14491* (2013.01)

(58) Field of Classification Search
CPC ..... B41J 2/14201; B41J 2/164; B41J 2/1642; B41J 2/1607; B41J 2/1623; B41J 2/1632
See application file for complete search history.

(56) References Cited

U.S. PATENT DOCUMENTS

| | | | |
|---|---|---|---|
| 2005/0270339 | A1 | 12/2005 | Sugahara |
| 2013/0194353 | A1 | 8/2013 | Hirai et al. |
| 2014/0210916 | A1 | 7/2014 | Hirai et al. |
| 2015/0085024 | A1 | 3/2015 | Hirai et al. |

* cited by examiner

LIQUID JET APPARATUS AND METHOD FOR MANUFACTURING LIQUID JET APPARATUS

CROSS REFERENCE TO RELATED APPLICATION

The present application is a continuation of U.S. patent application Ser. No. 14/757,493 filed Dec. 23, 2015, which claims priority from Japanese Patent Application No. 2014-264176 filed on Dec. 26, 2014, the disclosures of which are incorporated herein by reference in their entirety.

BACKGROUND

Field of the Invention

The present teaching relates to liquid jet apparatuses configured to jet a liquid, and to a method for manufacturing a liquid jet apparatus.

Description of the Related Art

Conventionally, there is known an ink jet head as a liquid jet apparatus. An ink jet head has a channel forming substrate in which a plurality of pressure chambers aligned in a predetermined direction are formed, and a plurality of piezoelectric elements arranged on a vibration film covering the plurality of pressure chambers of the channel forming substrate to correspond respectively to the plurality of pressure chambers.

Each of the piezoelectric elements has a piezoelectric layer, a lower electrode film arranged under the piezoelectric layer, and an upper electrode film arranged above the piezoelectric layer. The piezoelectric layer is formed across the plurality of pressure chambers. By partially removing the piezoelectric layer in areas between the plurality of pressure chambers, a plurality of openings are formed in the piezoelectric layer. The lower electrode film is an individual electrode provided individually for each of the pressure chambers. On the other hand, the upper electrode film is a common electrode arranged across the plurality of pressure chambers to serve for the plurality of piezoelectric elements.

A trace (leading electrode, drive trace) is connected to each of the lower electrode films which are individual electrodes, for connection with a driver IC to drive the piezoelectric element. These wires are arranged above the piezoelectric layer to be in electric conduction with the lower electrode films via through holes formed in the piezoelectric layer.

SUMMARY

There are known ink jet heads in which the traces are arranged above the piezoelectric layer to connect with the lower electrode films which are the individual electrodes. In this case, it is also possible to adopt a configuration of arranging those traces below the piezoelectric layer. That is, the traces may extend from the lower electrode films directly along the surface of the channel forming substrate.

Further, according to some patent documents, there may be such cases of only disclosing a configuration of arraying the plurality of piezoelectric elements in one row. However, if the plurality of piezoelectric elements are arrayed in a plurality of rows not less than two rows, then depending on the direction of drawing out the trace of each piezoelectric element, between the piezoelectric elements forming one row, the traces connected to the piezoelectric elements of another row may pass therethrough.

In the case of adopting the above configuration, and forming the openings of the piezoelectric layer formed across the plurality of pressure chambers by etching and removing the parts between the plurality of pressure chambers, if the traces are arranged in the parts where the openings are formed, then the traces are liable to be etched together when the piezoelectric layer is etched. Hence, the traces decrease in thickness and increase in resistance value while trace disconnection is liable to occur, thereby lowering the electrical reliability.

One of objects of the present teaching is providing a liquid jet apparatus capable of restraining the traces from increasing in resistance value and of securing the electrical reliability even if the traces are partly etched at the same time due to the etching of the piezoelectric layer, in the configuration of arranging the traces between a plurality of pressure chambers to correspond to other pressure chambers.

According to a first aspect of the present teaching, there is provided a liquid jet apparatus including:

a channel substrate including a first pressure chamber, a second pressure chamber, a third pressure chamber arranged adjacent to the second pressure chamber and a film covering the first, second and third pressure chambers;

a first piezoelectric element arranged above the first pressure chamber;

a second piezoelectric element arranged above the second pressure chamber;

a third piezoelectric element arranged above the third pressure chamber, and arranged adjacent to the second piezoelectric element, the second and third piezoelectric elements including a piezoelectric layer formed over the film to overlap with the second and third pressure chamber, and each of the second and third piezoelectric element including an individual electrodes arranged between the piezoelectric layer and the film; and a trace arranged between the film and the piezoelectric layer to extend from the first piezoelectric element and pass through between the individual electrodes of the second and third piezoelectric elements, wherein the piezoelectric layer defines an absent area at which the piezoelectric layer is absent, the absent area being located between the individual electrodes of the second and third piezoelectric elements; and wherein the liquid jet apparatus further comprises a metallic film formed on a portion of the trace overlapping with the absent area to cover the trace.

According to the present teaching, the metallic film is formed after the piezoelectric layer is etched, and layered on second traces included in the trace and exposed from the piezoelectric layer. Therefore, even when the second traces are lessened and thinned in terms of thickness when the piezoelectric layer is etched, the second traces are still improved in electrical reliability because the metallic film is layered later.

According to a second aspect of the present teaching, there is provided a liquid jet apparatus configured to jet liquid, including:

a channel substrate including a first pressure chamber, a second pressure chamber, a third pressure chamber arranged adjacent to the second pressure chamber and a film covering the first, second and third pressure chambers;

a first piezoelectric element arranged above the first pressure chamber;

a second piezoelectric element arranged above the second pressure chamber;

a third piezoelectric element arranged above the third pressure chamber, and arranged adjacent to the second piezoelectric element, the second and third piezoelectric elements including a piezoelectric layer formed over the film to overlap with the second and third pressure chamber, and each of the second and third piezoelectric element including an individual electrodes arranged between the piezoelectric layer and the film;

a film-like member positioned above the piezoelectric layer at a side opposite to the film;

a trace arranged between the film and the piezoelectric layer to extend from the first piezoelectric element and pass through between the individual electrodes of the second and third piezoelectric elements; and a metallic film covering the trace in an area of the trace positioned between the individual electrodes of the second and third piezoelectric elements, and formed of the same material as the film-like member.

According to a third aspect of the present teaching, there is provided a liquid jet apparatus configured to jet liquid, including:

a channel substrate including a first pressure chamber, a second pressure chamber, a third pressure chamber arranged adjacent to the second pressure chamber and a film covering the first, second and third pressure chambers;

a first piezoelectric element arranged above the first pressure chamber;

a second piezoelectric element arranged above the second pressure chamber;

a third piezoelectric element arranged above the third pressure chamber, and arranged adjacent to the second piezoelectric element, the second and third piezoelectric elements including a piezoelectric layer formed over the film to overlap with the second and third pressure chamber, and each of the second and third piezoelectric element including an individual electrodes arranged between the piezoelectric layer and the film; and a trace arranged between the film and the piezoelectric layer to extend from the first piezoelectric element and pass through between the individual electrodes of the second and third piezoelectric elements, wherein an opening is provided in the piezoelectric layer at an area between the two adjacent individual electrodes;

wherein the piezoelectric layer defines an absent area at which the piezoelectric layer is absent, the absent area being located between the individual electrodes of the second and third piezoelectric elements; and wherein the trace includes a first portion overlapping with the absent area and a second portion not overlapping with the absent area, the first portion being thicker than the second portion.

According to a fourth aspect of the present teaching, there is provided a method for manufacturing the liquid jet apparatus according to the first aspect, including:

forming the piezoelectric layer on the film to cover across the second and third pressure chambers;

forming the individual electrodes of the second and third piezoelectric elements to be arranged on the surface of the piezoelectric layer at the side of the film;

forming a trace drawn out from the first piezoelectric element;

etching and removing the piezoelectric layer between the second and third pressure chambers to form the absent area; and forming the metallic film on the trace overlapping with the absent area formed by etching the piezoelectric layer.

According to the present teaching, after etching and removing the piezoelectric layer between two of the pressure chambers, the metallic film is formed on the second traces exposed from the piezoelectric layer by the etching. By virtue of this, even if the second traces are etched together due to etching the piezoelectric layer and thus thinned in terms of film thickness, it is still possible to restrain the second traces from increasing in resistance value by overlaying the metallic film thereupon later.

BRIEF DESCRIPTION OF THE DRAWINGS

FIGS. 6A to 6D show steps of manufacturing the piezoelectric actuator, wherein FIG. 6A shows the step of forming a vibration film, FIG. 6B shows the step of forming a lower electrode and wires, FIG. 6C shows the step of forming a piezoelectric layer, and FIG. 6D shows the step of etching the piezoelectric layer;

FIGS. 7A and 7B show other steps of manufacturing the piezoelectric actuator, wherein FIG. 7A shows the step of forming an electroconductive film for an upper electrode and FIG. 7B shows the step of etching the electroconductive film (forming the upper electrode and a metallic first film);

FIGS. 8A to 8C show still other steps of manufacturing the piezoelectric actuator, wherein FIG. 8A shows the step of forming a mask of photoresist, FIG. 8B shows the step of forming an auxiliary electrode and a metallic second film by way of gold coating, and FIG. 8C shows the step of detaching the photoresist;

FIGS. 9A to 9D show steps of manufacturing a piezoelectric actuator (especially the steps of forming metallic films) according to a modification of the embodiment, wherein FIG. 9A shows the step of forming an upper electrode, FIG. 9B shows the step of forming an electroconductive film of an aluminum alloy, FIG. 9C shows the step of etching the electroconductive film, and FIG. 9D shows the step of forming a protective film.

DESCRIPTION OF THE EMBODIMENT

Figure 1:
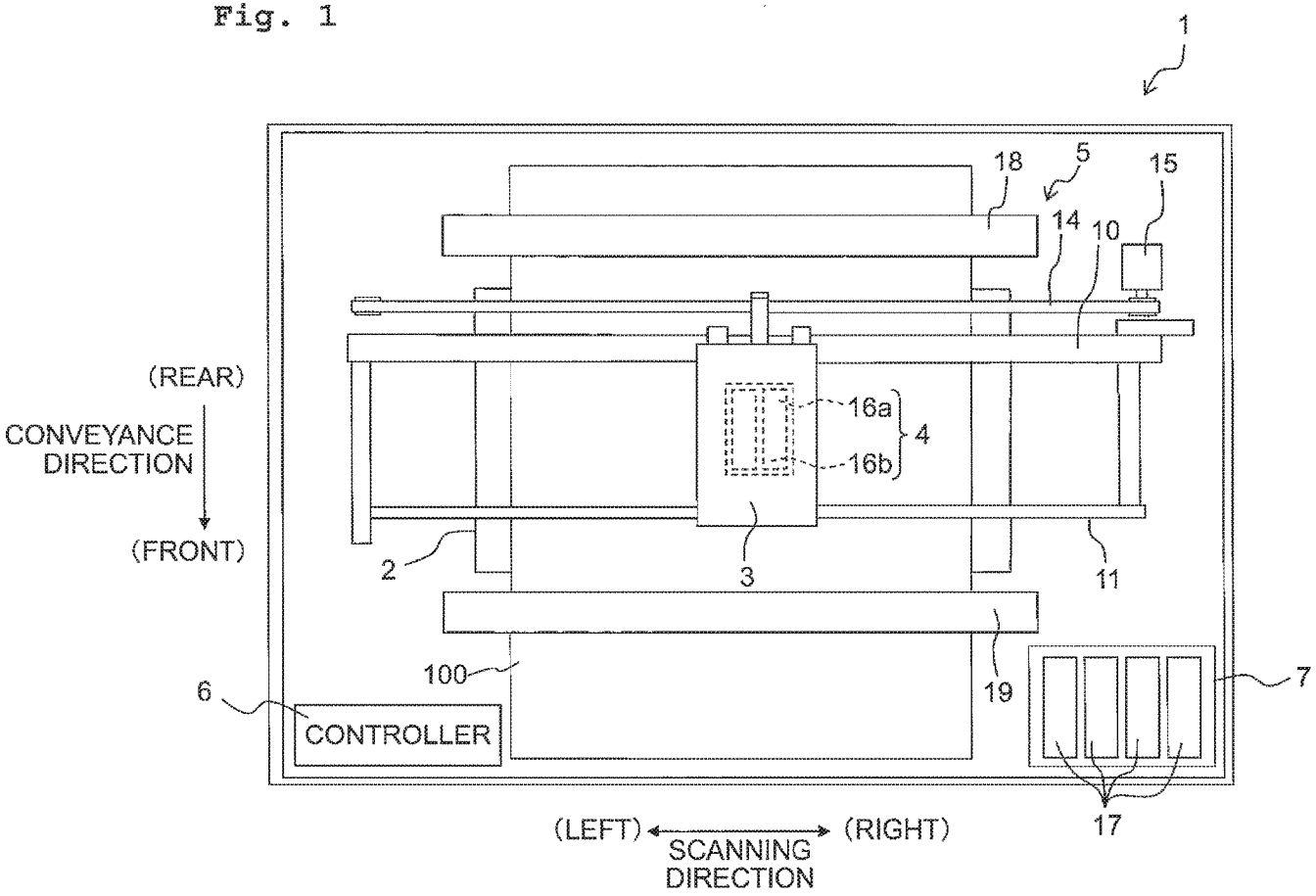
FIG. 1 is a schematic plan view of a printer according to an embodiment of the present teaching.

Next, an embodiment of the present teaching will be explained. Referring to FIG. 1, a schematic configuration of an ink jet printer 1 will be explained. Further, the front, rear, left and right directions depicted in FIG. 1 are defined as "front", "rear", "left" and "right" of the printer, respectively. Further, the near side of the page of FIG. 1 is defined as "upper side" or "upside", while the far side of the page is defined as "lower side" or "downside".

<Schematic Configuration of the Printer>

As depicted in FIG. 1, the ink jet printer 1 includes a platen 2, a carriage 3, an ink jet head 4, a conveyance mechanism 5, a controller 6, etc.

On the upper surface of the platen 2, there is carried a sheet of recording paper 100 which is a recording medium. The carriage 3 is configured to be movable reciprocatingly in a scanning direction along two guide rails 10 and 11 in a region facing the platen 2. An endless belt 14 is linked to the carriage 3, and a carriage drive motor 15 drives the endless belt 14 whereby the carriage 3 is moved in the scanning direction.

The ink jet head 4 is fitted on the carriage 3 to move in the scanning direction together with the carriage 3. The ink jet head 4 is connected, respectively through unshown tubes, with a cartridge holder 7 in which ink cartridges 17 are installed to retain inks of four colors (black, yellow, cyan, and magenta). The ink jet head 4 includes two head units 16 (16*a* and 16*b*) aligning in the scanning direction. Each of the head units 16*a* and 16*b* has a plurality of nozzles 24 (see FIGS. 2 to 4) formed in its lower surface (the surface on the far side of the page of FIG. 1) to jet the inks respectively toward the recording paper 100 carried on the platen 2. The head unit 16*a*, one of the two head units 16, serves to jet the inks of the two colors of black and yellow, while the other head unit 16*b* serves to jet the inks of the two colors of cyan and magenta.

The conveyance mechanism 5 has two conveyance rollers 18 and 19 arranged to interpose the platen 2 therebetween in a conveyance direction. With the two transport rollers 18 and 19, the conveyance mechanism 5 conveys the recording paper 100 carried on the platen 2 in the conveyance direction.

The controller 6 is provided with a ROM (Read Only Memory), a RAM (Random Access Memory), an ASIC (Application Specific Integrated Circuit) including various types of control circuits, etc. Following programs stored in the ROM, the controller 6 uses the ASIC to carry out various processes such as printing on the recording paper 100 and the like. For example, in a printing process, based on a print command input from an external device such as a PC or the like, the controller 6 controls the head units 16 of the ink jet head 4, the carriage drive motor 15 and the like to print image and the like on the recording paper 100. In particular, the controller 6 causes those members to alternately carry out an ink jet operation to jet the inks while moving the ink jet head 4 together with the carriage 3 in the scanning direction, and a conveyance operation to let the conveyance rollers 18 and 19 convey the recording paper 100 in the conveyance direction by a predetermined length.

<The Head Units of the Ink Jet Head>

Figure 2:
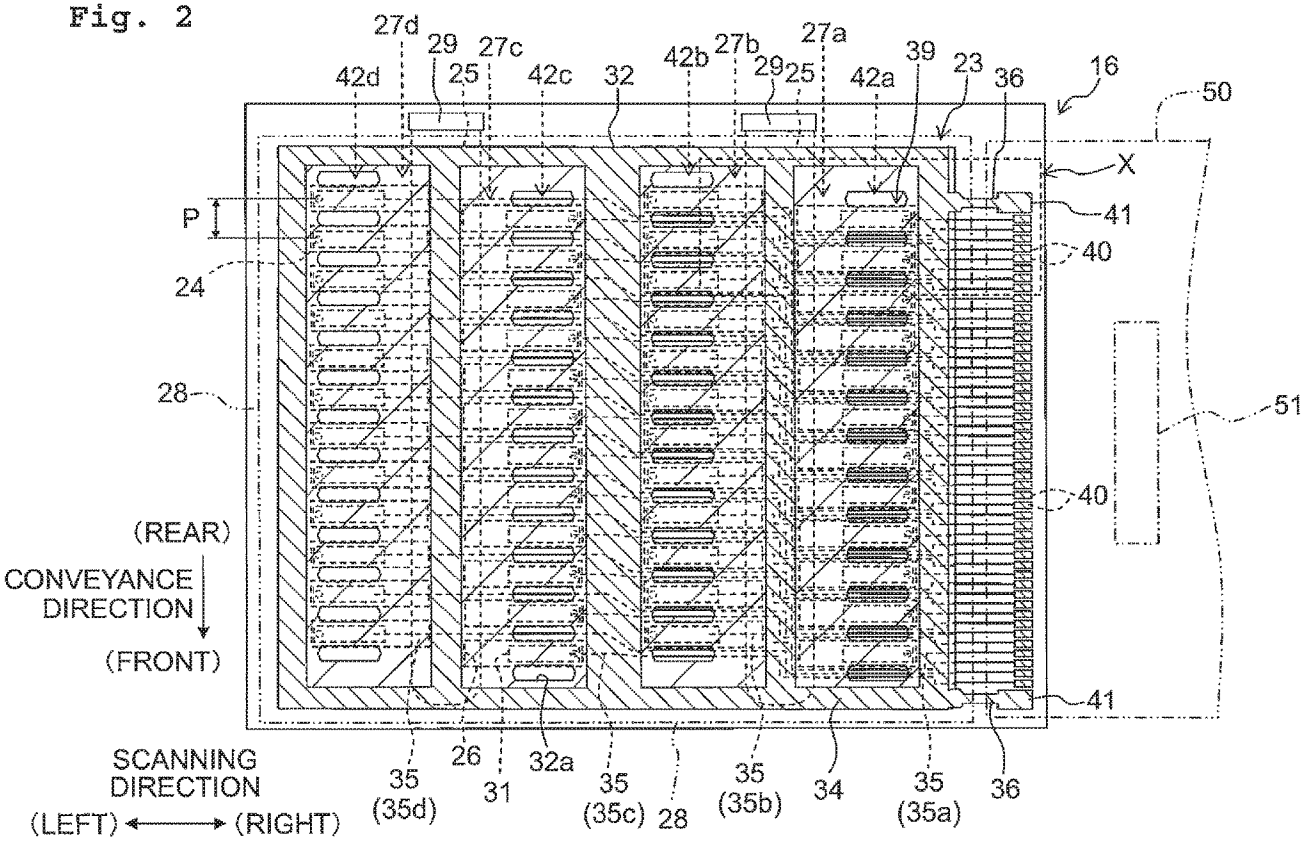
FIG. 2 is a top view of a head unit of an ink jet head.
Figure 3:
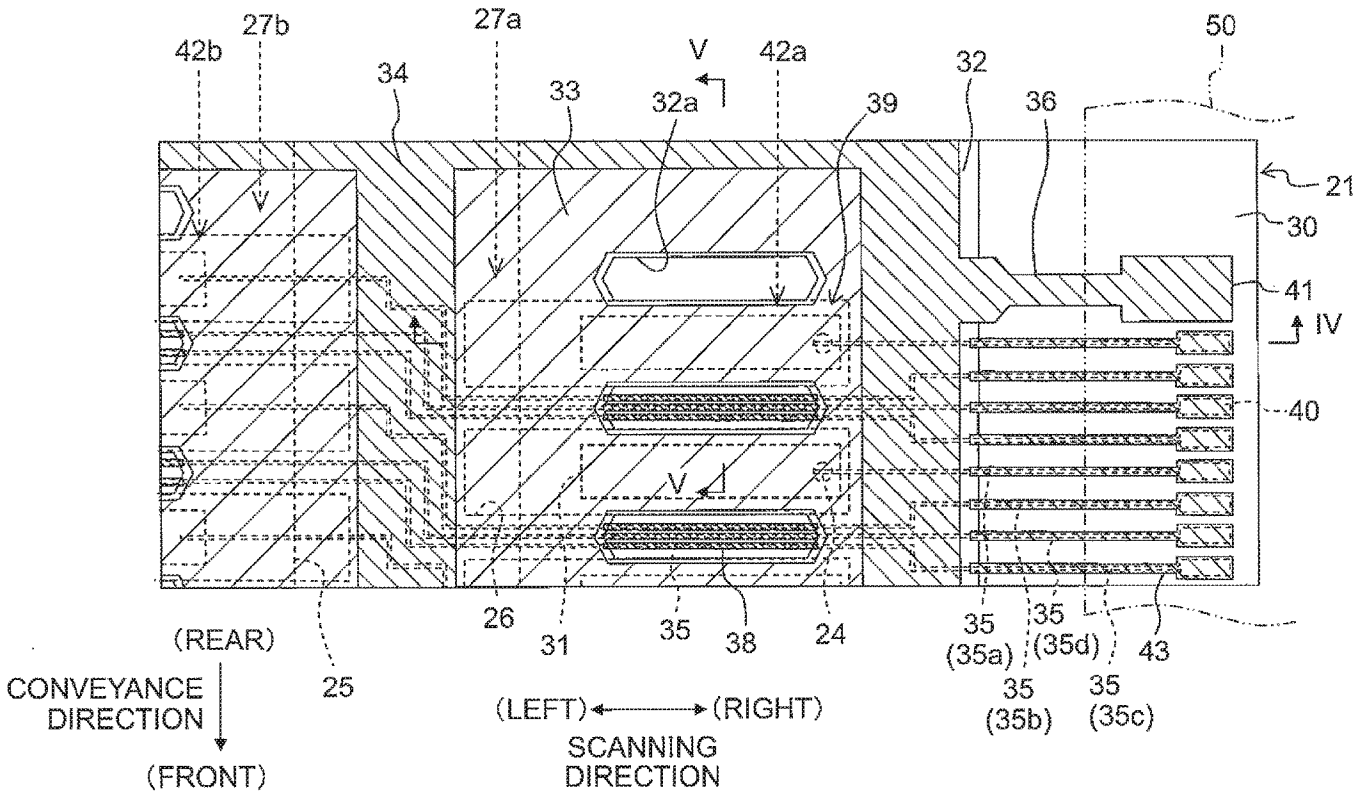
FIG. 3 is an enlarged view of part X of FIG. 2.
Figure 4:
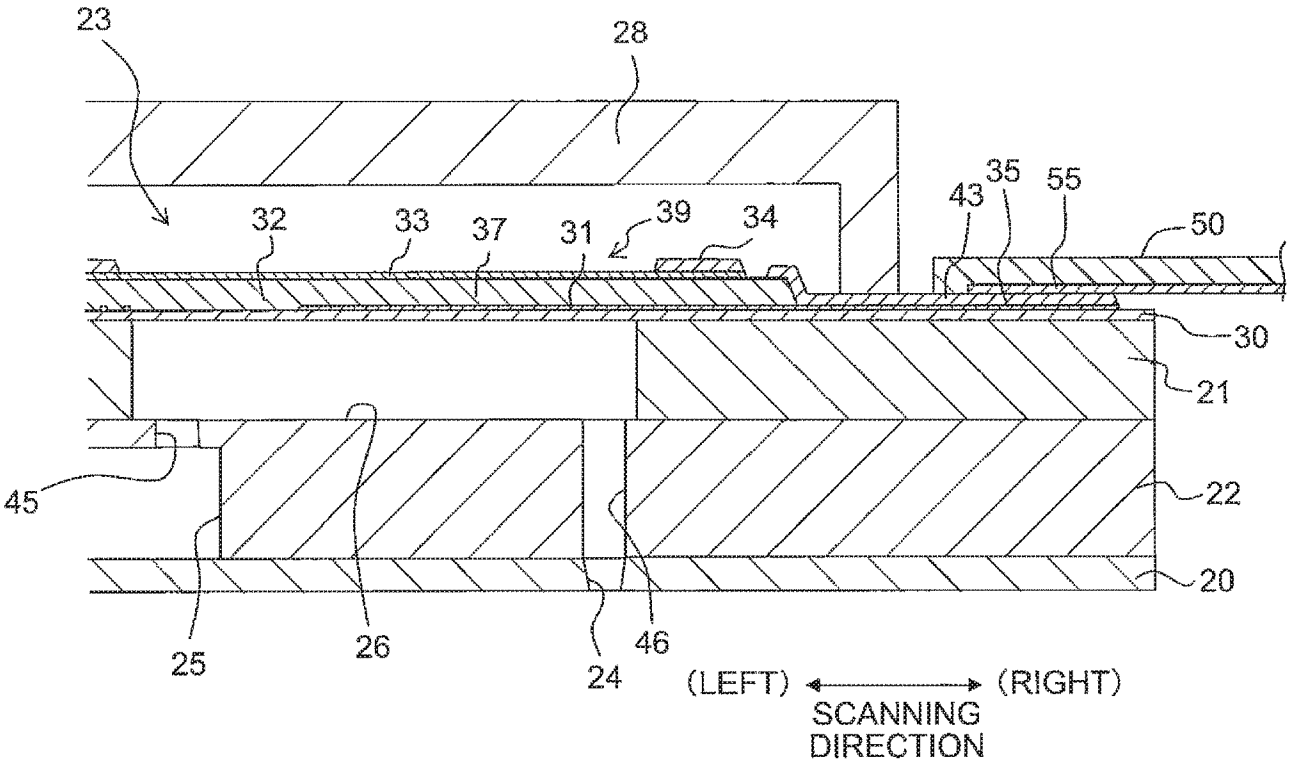
FIG. 4 is a cross-sectional view taken along the line IV-IV of FIG. 3.

Next, a configuration of the head units 16 of the ink jet head 4 will be explained. Further, because the two head units 16*a* and 16*b* have the same structure, the head unit 16*a* for jetting the black and yellow inks will be explained below as the representative thereof. As depicted in FIGS. 2 to 5, the head unit 16 includes a nozzle plate 20, a first channel substrate 21, a second channel substrate 22, a piezoelectric actuator 23, etc. Further, in order to simplify FIG. 2, only a lineation is drawn with a two-dot chain line to show a protective member 28 positioned above the first channel substrate 21 as depicted in FIG. 4.

<The Nozzle Plate>

The nozzle plate 20 is, for example, formed of silicon or the like. The plurality of nozzles 24 are formed in the nozzle plate 20. As depicted in FIG. 2, the plurality of nozzles 24 are arrayed in the conveyance direction to form four nozzle rows aligning in the scanning direction. The two nozzle rows on the right side serve to jet the black ink. Between the two nozzle rows on the right side, the nozzles 24 deviate in position in the conveyance direction by half the arrayal pitch P (P/2) of each nozzle row. The two nozzle rows on the left side serve to jet the yellow ink. In the same manner as between the two nozzle rows on the right side, between the two nozzle rows on the left side, the nozzles 24 also deviate in position by P/2 in the conveyance direction.

(Channel Member)

The first channel substrate 21 and the second channel substrate 22 are substrates made of silicon single crystal, respectively. In the first channel substrate 21, a plurality of pressure chambers 26 are formed in respective communication with the plurality of nozzles 24. Each of the pressure chambers 26 has such a planar shape as a rectangle elongated in the scanning direction. The plurality of pressure chambers 26 are arrayed in the conveyance direction in accordance with the plurality of nozzles 24 to form four pressure chamber rows 27 (27*a* to 27*d*) aligning in the scanning direction. The two pressure chamber rows 27*a* and 27*b* on the right side are the pressure chamber rows 27 for the black ink, whereas the two pressure chamber rows 27*c* and 27*d* on the left side are the pressure chamber rows 27 for the yellow ink. Further, the first channel substrate 21 has a vibration film 30 formed on its upper surface to cover the plurality of pressure chambers 26. The vibration film 30 is formed by oxidizing or nitriding a surface of a silicon substrate.

The second channel substrate 22 is joined to the lower surface of the first channel substrate 21. Further, the aforementioned nozzle plate 20 is joined to the lower surface of the second channel substrate 22. Two manifolds 25 are formed respectively in such a part of the second channel substrate 22 as to overlap vertically with the two pressure chamber rows 27*a* and 27*b* on the right side, and in such a part of the second channel substrate 22 as to overlap vertically with the two pressure chamber rows 27*c* and 27*d* on the left side. Each of the manifolds 25 extends along the conveyance direction which is the direction of arraying the pressure chambers 26. As depicted in FIG. 4, through a communication hole 45, each of the manifolds 25 is in communication with the pressure chamber 26 belonging to the pressure chamber row 27 corresponding thereto. Further, as depicted in FIG. 2, the two manifolds 25 are in respective communication with two ink supply ports 29 formed in the first channel substrate 21. Then, the two ink supply ports 29 are connected, respectively through unshown tubes or the like, with two of the ink cartridges 17 (see FIG. 1) installed in the cartridge holder 7. The inks supplied from the ink cartridges 17 are supplied to the manifolds 25 and, further, supplied respectively to the corresponding plurality of pressure chambers 26 from the manifolds 25. Further, communication holes 46 are also formed in the second channel substrate 22 to allow respective communication between the pressure chambers 26 formed in the first channel substrate 21, and the nozzles 24 formed in the nozzle plate 20.

With the piezoelectric actuator 23 which will be described next, if a jet energy is applied to the inks in the pressure chambers 26, then liquid droplets of the inks are jetted from the nozzles 24 in communication with the pressure chambers 26.

<The Piezoelectric Actuator>

The piezoelectric actuator 23 serves to apply the jet energy to the inks in the plurality of pressure chambers 26 for the nozzles 24 to jet the inks respectively. The piezoelectric actuator 23 has a plurality of piezoelectric elements 39 arranged on the upper surface of the vibration film 30 of the first channel substrate 21 to correspond respectively to the plurality of pressure chambers 26. Each of the piezoelectric elements 39 has a piezoelectric portion 37, a lower electrode 31, and an upper electrode 33. Further, as depicted in FIG. 4, the protective member 28 is joined to the upper surface of the first channel substrate 21 to cover the plurality of piezoelectric elements 39 of the piezoelectric actuator 23.

A configuration of the piezoelectric elements 39 will be explained in detail. The lower electrodes 31 of the plurality of piezoelectric elements 39 are formed respectively in such areas of the upper surface of the vibration film 30 of the first channel substrate 21 as to face the plurality of pressure chambers 26. That is, the lower electrodes 31 are individual electrodes provided individually for the respective pressure chambers 26. The plurality of lower electrodes 31 are arrayed in the conveyance direction to correspond to the arrayal of the plurality of pressure chambers 26, to form four electrode rows 42 (42*a* to 42*d*). The lower electrodes 31 are not limited to any particular shape but, as depicted in FIG. 3 for example, have such a rectangular shape smaller in planar view than that of the pressure chambers 26. Further, the lower electrodes 31 are formed of platinum (Pt).

A piezoelectric layer 32 is formed on the upper surface of the vibration film 30 to cover the plurality of lower electrodes 31. The piezoelectric layer 32 is formed on the upper surface of the vibration film 30 to cover the plurality of pressure chambers 26 of the four pressure chamber rows 27. The piezoelectric layer 32 is a rectangular film in planar view. Further, a part of the piezoelectric layer 32 facing each of the pressure chambers 26 forms the piezoelectric portion 37 of one of the piezoelectric elements 39. That is, the piezoelectric layer 32 can be regarded as a film formed of the mutually connected piezoelectric portions 37 of the plurality of piezoelectric elements 39. The piezoelectric layer 32 is formed of, for example, a piezoelectric material composed primarily of lead zirconate titanate (PZT) which is a mixed crystal of lead titanate and lead zirconate. Alternatively, the piezoelectric layer 32 may be formed of non-lead-based piezoelectric material in which no lead is contained.

Further, in such parts of the piezoelectric layer 32 as between the plurality of pressure chambers 26 (the parts between the adjacent piezoelectric portions 37) belonging to the respective pressure chamber rows 27, openings 32*a* are formed by way of etching. These openings 32*a* separate the piezoelectric portions 37 between the adjacent piezoelectric elements 39, thereby facilitating deformation of each of the piezoelectric portions 37.

The upper electrode 33 is formed on the upper surface of the piezoelectric layer 32 across almost the entire surface. That is, the upper electrode 33 serves as a common electrode for the plurality of piezoelectric elements 39, commonly facing the lower electrodes 31 of the plurality of piezoelectric elements 39 across the piezoelectric layer 32. In other words, in the upper electrode 33, a plurality of electrode parts are integrated as in electric conduction with one another, respectively facing the plurality of lower electrodes 31. The upper electrode 33 is formed of, for example, iridium (Ir).

As depicted in FIGS. 2 to 4, an auxiliary electrode 34 thicker than the upper electrode 33 is layered on the upper surface of the upper electrode 33. The auxiliary electrode 34 is arranged in the periphery of the upper electrode 33 and the parts between the four pressure chamber rows 27*a* to 27*d*. Further, the auxiliary electrode 34 neither faces the respective pressure chambers 26 nor faces the lower electrodes 31. The auxiliary electrode 34 is formed of gold (Au). In this manner, because the thicker auxiliary electrode 34 is provided on the upper electrode 33, it is possible to keep the respective piezoelectric portions 37 from deformation inhibition by thinning the upper electrode 33 arranged across the upper surface of the plurality of piezoelectric portions 37. At the same time, the thicker auxiliary electrode 34 can reduce the electrical resistance of the entire common electrode. Further, the auxiliary electrode 34 may face only some of the pressure chambers 26. In such cases, the auxiliary electrode 34 is also arranged at least not to face the lower electrodes 31.

Further, the piezoelectric portions 37 of the piezoelectric layer 32, which are interposed between the lower electrodes 31 and the upper electrode 33, are respectively polarized upward in the thickness direction, that is, in the direction from the lower electrodes 31 toward the upper electrode 33.

As depicted in FIGS. 2 to 4, on the upper surface of the vibration film 30, a plurality of traces 35 are arranged to connect respectively to the lower electrodes 31 of the plurality of piezoelectric elements 39. The plurality of traces 35 are formed of platinum as with the lower electrodes 31, and undergo film forming and patterning through the same process as the plurality of lower electrodes 31. Further, the traces 35 are smaller in width than the lower electrodes 31 according to the conveyance direction.

In this embodiment as depicted in FIGS. 2 and 3, all of the plurality of traces 35, which are connected respectively to the plurality of lower electrodes 31, extend rightward from the corresponding lower electrodes 31. For example, the traces 35, which are drawn out from the lower electrodes 31 belonging to the three electrode rows 42 (42*b* to 42*d*) positioned on the left side, also extend rightward. Then, those traces 35 pass through between the lower electrodes 31 belonging to the other electrode row 42 positioned on the right side. As depicted in FIG. 3 for example, in the area between the lower electrodes 31 belonging to the electrode row 42*a* positioned on the rightmost side, the three traces 35*b* to 35*d* are arranged to correspond respectively to the three electrode rows 42*b* to 42*d* positioned on the left side.

Drive contact portions 40 are provided respectively at the right ends of the plurality of traces 35. Further, as depicted in FIGS. 3 and 4, metallic films 43 formed of gold cover up such right end portions of the respective traces 35 that are exposed from the piezoelectric layer 32 and include the drive contact portions 40. Further, as depicted in FIGS. 2 and 3, two common traces 36 are respectively drawn out rightward also from the auxiliary electrode 34 arranged on the upper surface of the piezoelectric layer 32 to be in electric conduction with the upper electrode 33. These common traces 36 are formed of gold (Au). Ground contact portions 41 are provided at the right ends of the common traces 36. Then, the plurality of drive contact portions 40 provided respectively for the plurality of traces 35 and the two ground contact portions 41 provided respectively for the two common traces 36 are arranged to align in the conveyance direction on the upper surface of a right end portion of the first channel substrate 21.

Here, as described above, in the parts of the piezoelectric layer 32 between plurality of pressure chambers 26 belonging to the respective pressure chamber rows 27 (the parts between the piezoelectric portions 37 of the adjacent piezoelectric elements 39), the openings 32*a* are formed by way of etching. Further, as depicted in FIGS. 2 and 3, in the three pressure chamber rows 27*a* to 27*c* on the right side (the electrode rows 42*a* to 42*c*), via the openings 32*a* formed in the piezoelectric layer 32, the traces 35 from the other electrode row 42 pass through between the adjacent lower electrodes 31 in the conveyance direction, and are exposed from the piezoelectric layer 32.

In such a configuration, when the openings 32*a* are formed in the piezoelectric layer 32 by way of etching (especially dry etching), it is possible for the traces 35 in the positions of forming the openings 32*a* to be etched at the same time. In such a case, the traces 35 are liable to be thinned in film thickness. Especially in this embodiment, because the traces 35 are formed of expensive platinum together with the lower electrodes 31, from the point of view of cost reduction, it is expected to form the films of the lower electrodes 31 and the traces 35 as thin as possible. However, if the traces 35 are thin in film thickness, then wiring disconnection is also liable to occur when the traces 35 are etched due to the etching of the piezoelectric layer 32.

In this embodiment, therefore, metallic films 38, which are formed after the piezoelectric layer 32 is etched, are layered on the traces 35 exposed from the piezoelectric layer 32 through the openings 32*a*. By virtue of this, the traces 35 are reinforced after the piezoelectric layer 32 is etched. In planar view as depicted in FIG. 3, the metallic films 38 are arranged across from the exposed traces 35 to the piezoelectric layer 32 to let their left and right end portions overlap with the piezoelectric layer 32. By virtue of this, the metallic films 38 cover up the entire traces 35 exposed through the openings 32*a*.

Figure 5:
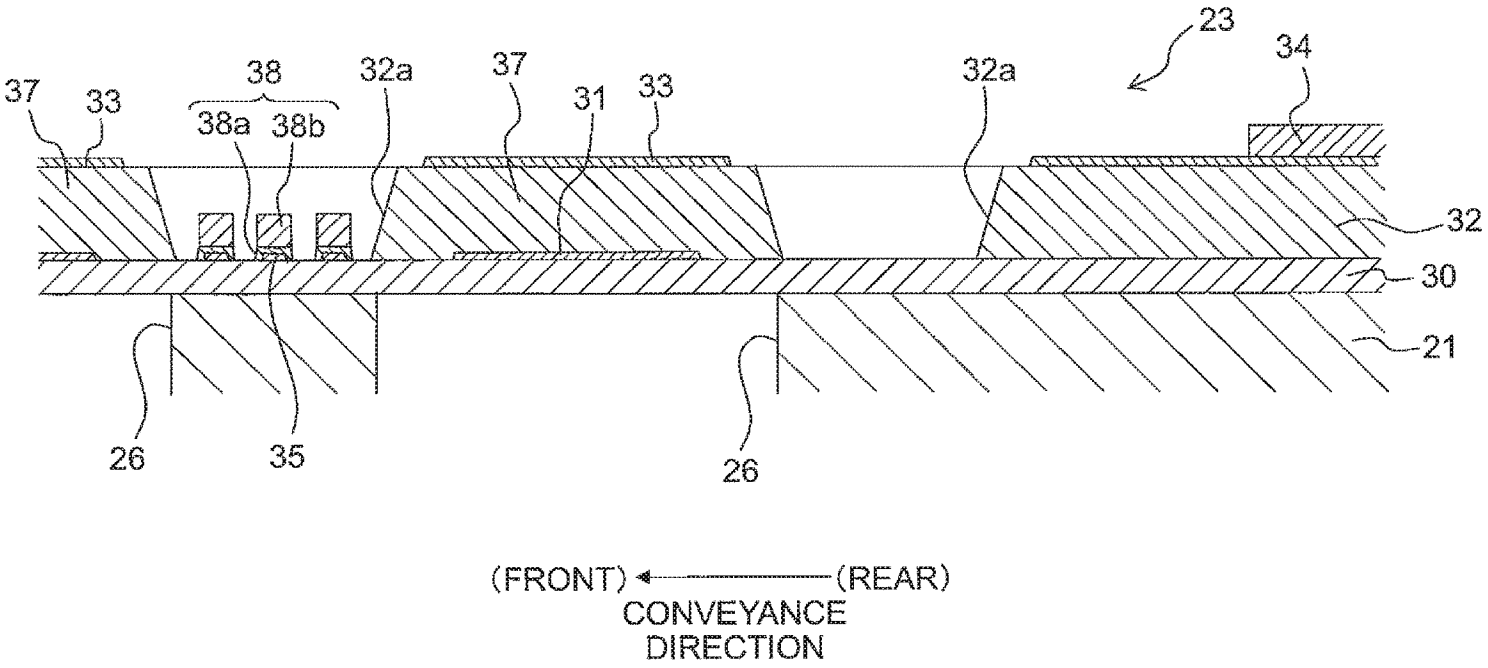
FIG. 5 is a cross-sectional view of a piezoelectric actuator, taken along the line V-V of FIG. 3.

While the metallic films 38 are not limited to a particular film configuration and film formation material, it is possible to form the metallic films 38 according to the following configuration, for example. As depicted in FIG. 5, each of the metallic films 38 has a first film 38*a* as its lower layer, and a second film 38*b* as its upper layer layered on the first film 38*a*. While a detailed explanation will be made later on, the first films 38*a* have the same thickness as the upper electrode 33 formed of the same material (iridium) through the same process of film formation as the upper electrode 33. Further, the second films 38*b* have the same thickness as the auxiliary electrode 34 formed of the same material (gold) through the same process of film formation as the auxiliary electrode 34 and the common traces 36 connected to the auxiliary electrode 34.

As depicted in FIGS. 2 to 4, a COF 50 is joined to the upper surface of a right end portion of the first channel substrate 21. Then, the plurality of drive contact portions 40 arranged in the right end portion of the first channel substrate 21 are electrically connected with plurality of wires 55 formed in the COF 50, respectively. Further, the two ground contact portions 41 arranged in the right end portion of the first channel substrate 21 are connected with a ground wire (not depicted) formed in the COF 50. Further, while illustration is omitted, the COF 50 is also connected to the controller 6 of the ink jet printer 1 (see FIG. 1).

A driver IC 51 is mounted on the COF 50. Based on a control signal sent in from the controller 6, the driver IC 51 generates and outputs a drive signal for driving each of the piezoelectric elements 39. The drive signal outputted from the driver IC 51 is inputted to the drive contact portions 40 via the wires 55 of the COF 50 and, furthermore, supplied to each of the lower electrodes 31 via the traces 35. The lower electrodes 31 supplied with the drive signal undergo a potential change between a predetermined drive potential and a ground potential. Further, with the ground contact portions 41 being connected with the ground wire of the COF 50, the upper electrode 33 connected to the ground contact portions 41 is constantly kept at the ground potential.

Now, an explanation will be made on an operation of each of the piezoelectric elements 39 when supplied with the drive signal from the driver IC 51. Without being supplied with the drive signal, the lower electrodes 31 are at the ground potential, that is, at the same potential as the upper electrode 33. From this state, when the drive signal is supplied to any one of the lower electrodes 31 to apply the drive potential to that lower electrode 31, then due to the potential difference between the lower electrode 31 and the upper electrode 33, an electric field acts on the corresponding piezoelectric portion 37 in a direction parallel to the thickness direction thereof. Here, because the polarization direction of the piezoelectric portion 37 is parallel to the direction of the electric field, the piezoelectric portion 37 extends in the thickness direction which is parallel to its polarization direction, so as to contract in the planar direction. Along with the contraction deformation of this piezoelectric portion 37, the vibration film 30 bows to project toward the pressure chamber 26. By virtue of this, the volume of the pressure chamber 26 decreases to bring about a pressure wave inside the pressure chamber 26, thereby jetting liquid droplets of the ink from the nozzle 24 in communication with the pressure chamber 26.

Next, an explanation will be made on steps of manufacturing, especially, the piezoelectric actuator 23 of the above-mentioned head unit 16 of the ink jet head 4. By forming and patterning various films in sequence on the vibration film 30 of the first channel substrate 21, the piezoelectric actuator 23 including the plurality of piezoelectric elements 39 is manufactured.

Figure 6A:
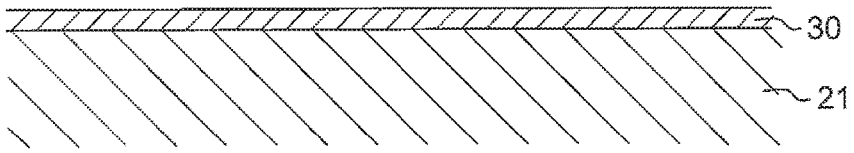
Figure 6B:
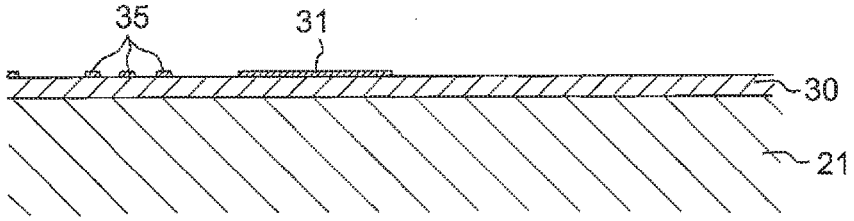

First, as depicted in FIG. 6A, the vibration film 30 of silicon dioxide or the like is formed on the surface of the first channel substrate 21 by way of thermal oxidation or the like. Next, as depicted in FIG. 6B, the lower electrodes 31 and the traces 35 to connect to the lower electrodes 31 are formed of platinum on the vibration film 30. That is, on the upper surface of the vibration film 30, after a film of gold is formed by way of sputtering or the like, the lower electrodes 31 and the traces 35 are formed by etching and patterning the gold film.

Figure 6C:
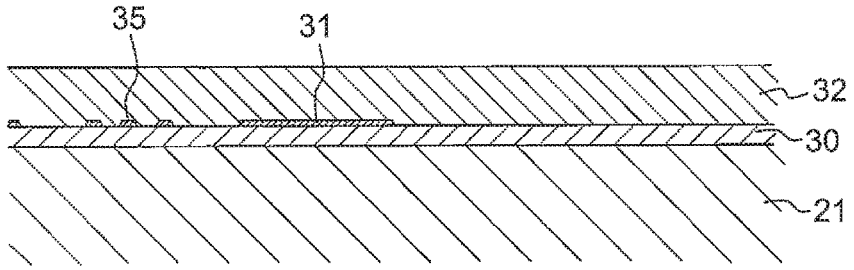
Figure 6D:
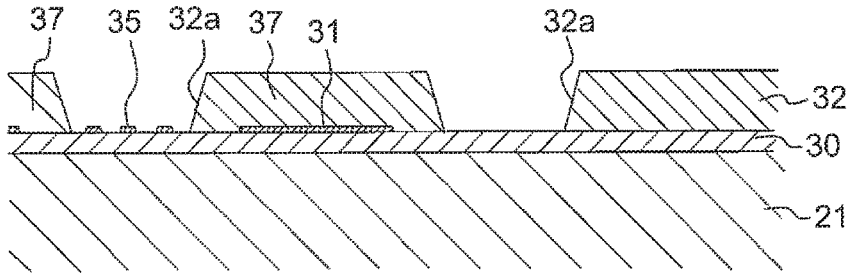

Next, the piezoelectric layer 32 is formed on the upper surface of the vibration film 30. First, as depicted in FIG. 6C, the piezoelectric layer 32 is formed on almost the entire area of the upper surface of the vibration film 30, by the sol-gel method, sputtering method or the like, to cover the plurality of lower electrodes 31 and the plurality of traces 35. Next, as depicted in FIG. 6D, the piezoelectric layer 32 is patterned by way of dry etching. At this time, the openings 32*a* are formed in the piezoelectric layer 32 also by way of dry etching to remove the parts of the piezoelectric layer 32 between the plurality of pressure chambers 26 forming each of the pressure chamber rows 27. Further, when the openings 32*a* are formed by way of the dry etching, the traces 35 may be thinned in film thickness due to the losing or lessening of, together with the piezoelectric layer 32, the traces 35 arranged below the parts of the piezoelectric layer 32 where the openings 32*a* are formed.

Figure 7A:
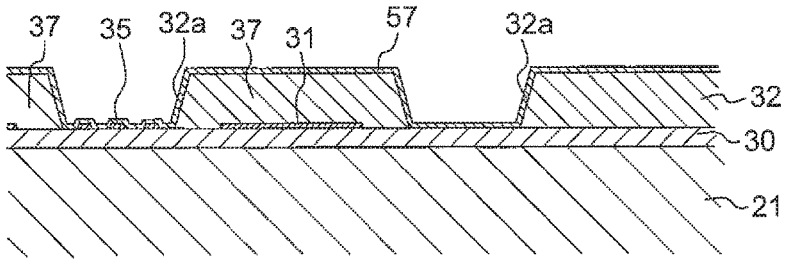
Figure 7B:
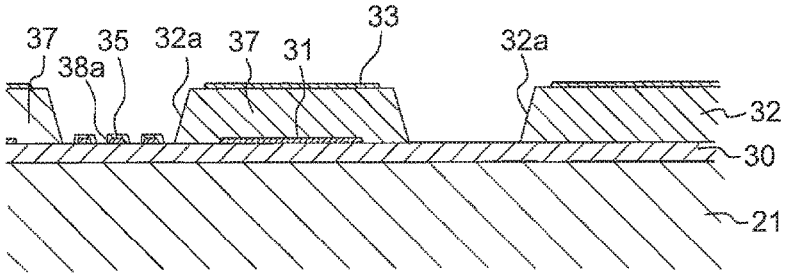

As depicted in FIG. 7A, an electroconductive film 57 is formed of iridium or the like by the sputtering method or the like to cover the upper surface of the piezoelectric layer 32, and the traces 35 exposed through the openings 32*a* of the piezoelectric layer 32. Next, as depicted in FIG. 7B, by etching and patterning the electroconductive film 57, the upper electrode 33 is formed on the upper surface of the piezoelectric layer 32, while the first films 38*a* are formed and separated from the upper electrode 33 to individually cover the exposed traces 35.

Next, the auxiliary electrode 34 and the second films 38*b* of the metallic films 38 are formed by way of gold coating.

Figure 8A:
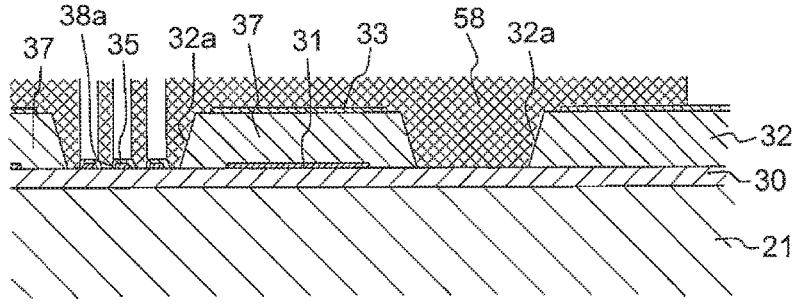
Figure 8B:
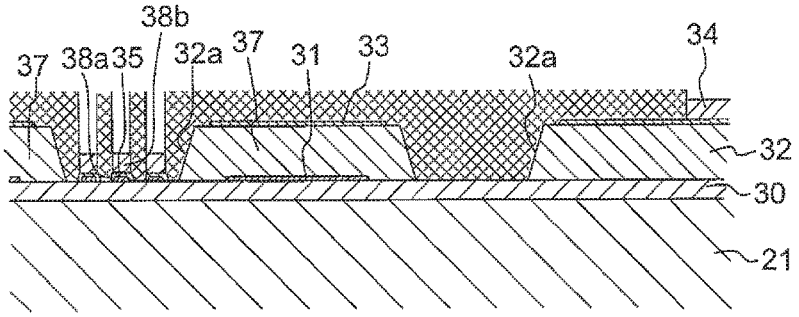
Figure 8C:
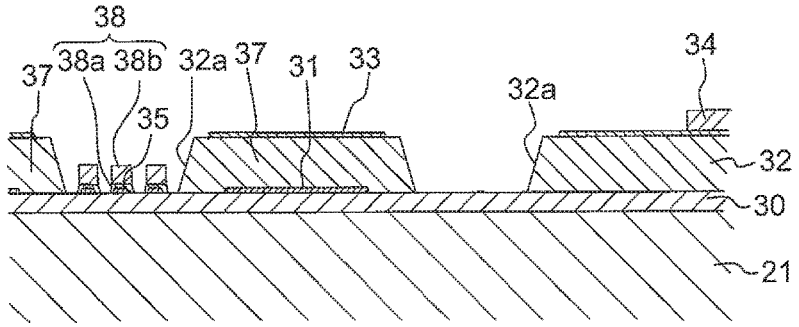

First, as depicted in FIG. 8A, a mask 58 of photoresist is provided on the upper surfaces of the vibration film 30 and the piezoelectric layer 32 except for some area of the upper electrode 33, and the areas of forming the traces 35 exposed from the piezoelectric layer 32 through the openings 32*a*. Next, as depicted in FIG. 8B, a gold film is formed on the areas not covered by the mask 58 by way of gold coating. By virtue of this, the auxiliary electrode 34 is formed on the upper surface of the piezoelectric layer 32 while the common traces 36 are formed to connect to the auxiliary electrode 34 and, furthermore, the second films 38*b* of the metallic films 38 are formed on the traces 35 exposed from the piezoelectric layer 32. Thereafter, as depicted in FIG. 8C, the mask 58 is detached.

In this manner, after etching the piezoelectric layer 32, the first films 38*a* and second films 38*b* of the metallic films 38 are layered in sequence on the traces 35 exposed through the openings 32*a*. By virtue of this, even when some of the traces 35 are etched at the same time due to the etching of the piezoelectric layer 32, the metallic films 38 reinforce the traces 35.

In the above manner, after forming the plurality of piezoelectric elements 39 on the vibration film 30, the protective member 28 (see FIG. 4) is joined to the first channel substrate 21 to cover the plurality of piezoelectric elements 39. Further, the plurality of pressure chambers 26 are formed in the first channel substrate 21 by way of etching. Further, after the second channel substrate 22 and the nozzle plate 20 are joined to the first channel substrate 21, manufacturing the head unit 16 is finished.

In this embodiment as explained above, in the openings 32*a* formed in the piezoelectric layer 32 by way of etching, the metallic films 38 are formed after the piezoelectric layer 32 is etched, and layered on the traces 35 exposed from the piezoelectric layer 32. When the openings 32*a* are formed in the piezoelectric layer 32 by way of etching, it is possible to lessen and thin the traces 35 in terms of thickness, in the areas where the openings 32*a* are formed. However, even when the traces 35 are lessened and thinned in terms of thickness due to the etching, the traces 35 are still improved in electrical reliability because the metallic films 38 are layered later.

Further, as depicted in FIG. 3, the metallic films 38 are formed after the piezoelectric layer 32 is etched. Therefore, some of the metallic films 38 are arranged on the piezoelectric layer 32. In this manner, the metallic films 38 are overlapped partially with the piezoelectric layer 32. Therefore, it is possible for the metallic films 38 to reliably cover the entire areas of such parts of the traces 35 as exposed from the piezoelectric layer 32.

Further, the metallic films 38 may be formed through the same film formation process as the other electrode films, so as not to add a special process for forming the metallic films 38.

In this regard, in this embodiment, the metallic films 38 have the first films 38*a* formed of the same material at the same thickness as the upper electrode 33, and the second films 38*b* formed of the same material at the same thickness as the auxiliary electrode 34 and common traces 36. Therefore, because it is possible to form the first films 38*a* through the same film formation process as the upper electrode 33, and form the second films 38*b* through the same film formation process as the auxiliary electrode 34 and common traces 36, no special process is needed for forming the metallic films 38.

Further, from the point of view of reinforcing the traces 35, it is desirable for the metallic films 38 to be thick. However, thickening the metallic films 38 leads to thickening those electrode films formed through the same film formation process as the metallic films 38. Therefore, when the upper electrode 33 facing the lower electrodes 31 is thickened, then the piezoelectric portions 37 are subject to deformation inhibition due to the thickened upper electrode 33.

In regard to this, the metallic films 38 in this embodiment have the second films 38*b* formed through the same film formation process as the auxiliary electrode 34, in addition to the first films 38*a* formed through the same film formation process as the upper electrode 33. First, because the metallic films 38 have two types of film, the effect of reinforcing the traces 35 is further improved. In addition to this, the auxiliary electrode 34, which is formed through the same film formation process as the second films 38*b* of the metallic films 38, is arranged in the areas not facing the lower electrodes 31. Therefore, even when the auxiliary electrode 34 becomes thicker because of thickening the second films 38*b* of the metallic films 38, the piezoelectric layer 32 is still less likely to undergo deformation inhibition due to that reason. Further, by arranging the thick auxiliary electrode 34 on the thin upper electrode 33, it is possible to obtain such an effect as to reduce the practical electric resistance of the common electrode.

In the embodiment explained above, the ink jet head 4 corresponds to "the liquid jet apparatus" of the present teaching. The first channel substrate 21 corresponds to "the channel substrate" of the present teaching. The lower electrodes 31 correspond to "the individual electrodes" of the present teaching, and the upper electrode 33 corresponds to "the common electrode" of the present teaching. The auxiliary electrode 34 corresponds to "the layered electrode" of the present teaching.

Next, an explanation will be made on a few modifications which modify the above embodiment in various ways. However, the same reference numerals or alphanumerals are assigned to the components identical or similar to those in the above embodiment, and any explanation therefor will be omitted as appropriate.

Figure 9A:
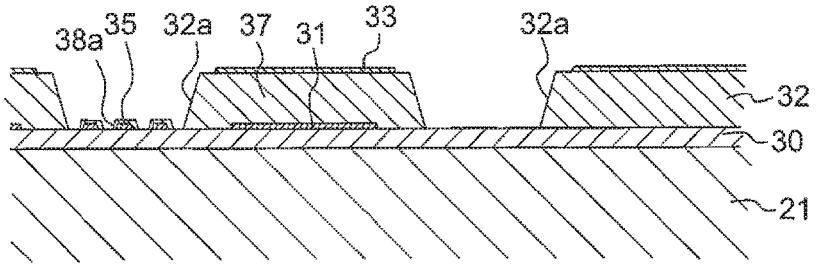
Figure 9B:
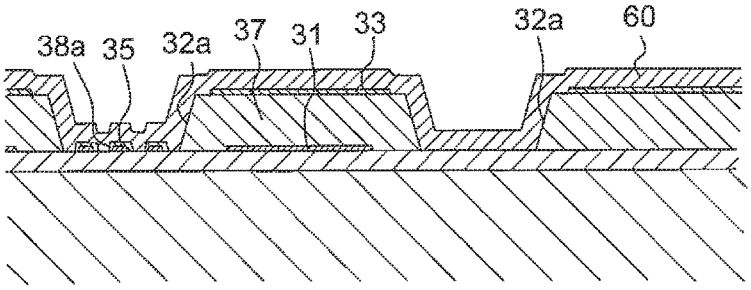
Figure 9C:
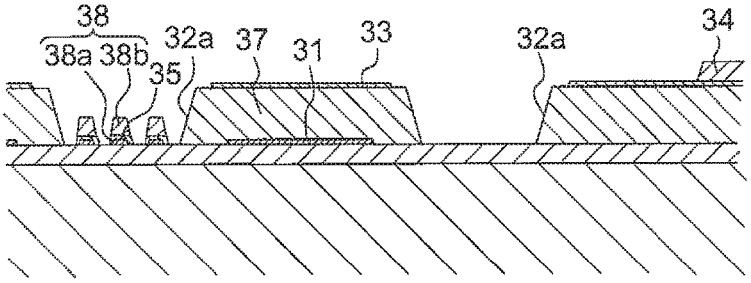
Figure 9D:
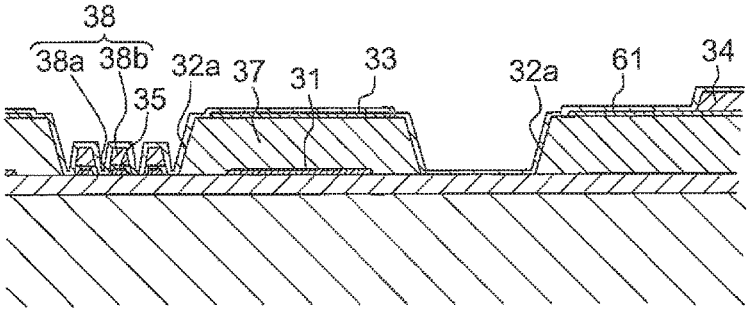

The metallic films 38 overlaid on the traces 35 are not limited to iridium or gold as their material. Further, the method of film formation may be changed as appropriate according to the material. For example, if the auxiliary electrode 34 is formed of an aluminum material (such as an Al—Cu alloy or the like), then it is possible to form the metallic films 38 through such steps as depicted in FIGS. 9A to 9D. FIGS. 9A to 9D depict the steps of manufacturing a piezoelectric actuator (especially the steps of forming metallic films) according to a modification of the embodiment, wherein FIG. 9A depicts the step of forming an upper electrode, FIG. 9B depicts the step of forming an electroconductive film of an aluminum alloy, FIG. 9C depicts the step of etching the electroconductive film, and FIG. 9D depicts the step of forming a protective film.

In the same manner as in the above embodiment, the upper electrode 33 and the first films 38*a* of the metallic films 38 are formed in FIG. 9A by forming the electroconductive film by way of sputtering or the like, and patterning the electroconductive film by way of etching. After the upper electrode 33 is formed, another electroconductive film 60 is then formed of an aluminum material from the upper surface of the piezoelectric layer 32 (the upper electrode 33) up to such areas of the piezoelectric layer 32 that the openings 32*a* are formed. Next, the electroconductive film 60 is etched and patterned to form the auxiliary electrode 34 and the second films 38*b* of the metallic films 38. Further, the aluminum material used here is more likely to give rise to migration than the gold used in the above embodiment. Therefore, in order to prevent the migration, as depicted in FIG. 9D, it is possible to form a protective film 61 made of an insulating material to cover the auxiliary electrode 34 and the second films 38*b* of the metallic films 38 which are all formed of the aluminum material. It is possible to use silicon nitride, silicon dioxide or alumina as the material for the protective film 61.

Figure 10A:
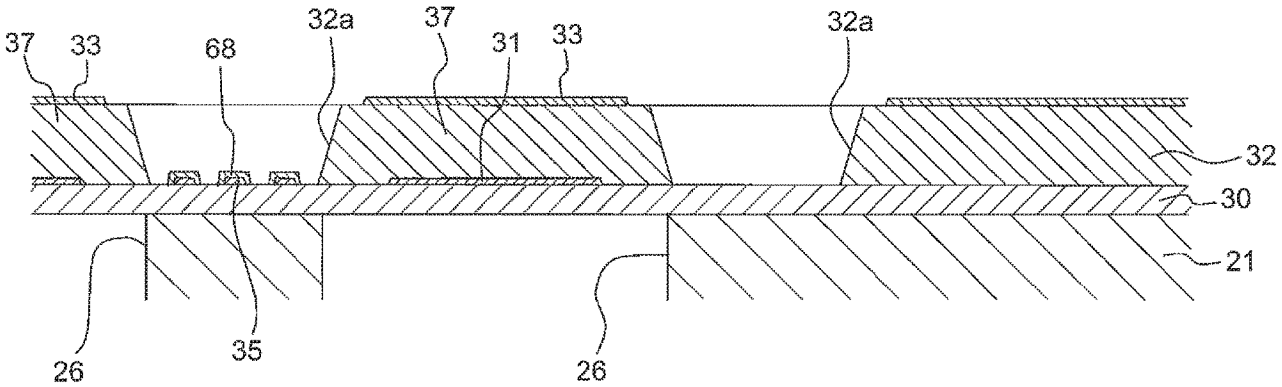
FIGS. 10A and 10B are cross-sectional views of a piezoelectric actuator according to another modification.
Figure 10B:
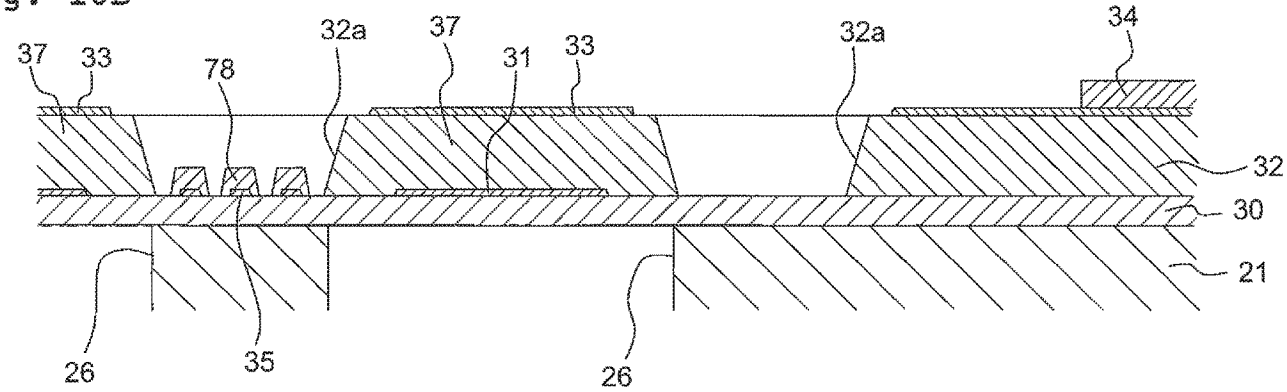

In the above embodiment, the metallic films 38 layered on the traces 35 exposed from the piezoelectric layer 32 have the first films 38*a* formed of the same material at the same thickness as the lower electrodes 31, and the second films 38*b* formed of the same material at the same thickness as the auxiliary electrode 34. In contrast to this, as depicted in FIG. 10A, each metallic film 68 may have only a film formed of the same material at the same thickness as the upper electrode 33 through the same film formation process as the upper electrode 33. It is possible to adopt the above configuration for such cases and the like where the upper electrode 33 is not provided with the auxiliary electrode 34. Alternatively, as depicted in FIG. 10B, each metallic film 78 may have only a film formed of the same material at the same thickness as the auxiliary electrode 34 through the same film formation process as the auxiliary electrode 34.

Still alternatively, metallic films may be formed on the traces 35 exposed from the piezoelectric layer 32 through a different process from the film formation process for the other electrode films. In such cases, it is possible to freely select a material for the metallic films regardless of the material of the other electrode films such as the lower electrodes 31, the auxiliary electrode 34, and the like.

In the above embodiment, the plurality of pressure chambers 26 form the four pressure chamber rows 27, and the plurality of piezoelectric elements 39 are also arrayed in four rows to correspond to the plurality of pressure chambers 26. However, the piezoelectric elements are not limited to four rows. For example, the present teaching is also applicable to such a configuration that the piezoelectric elements are arrayed in two rows, and the traces corresponding to one row of the piezoelectric elements are arranged between the piezoelectric elements of the other row.

In the above embodiment, as depicted in FIG. 2, the piezoelectric layer 32 is formed across all of the pressure chambers 26 arrayed in four rows. However, it is also possible to apply the present teaching to the case where the piezoelectric layer is divided into a plurality of parts. For example, four piezoelectric layers may be provided to be separate from one another to correspond respectively to the four pressure chamber rows 27. Further, a plurality of piezoelectric layers may be provided individually to correspond respectively to the plurality of pressure chambers 26. That is, it may be configured to have mutually separated piezoelectric portions of the plurality of piezoelectric elements.

The embodiment and its modifications explained above have applied the present teaching to a piezoelectric actuator of an ink jet head configured to print image and the like by jetting ink to recording paper. However, it is also possible to apply the present teaching to any liquid jet apparatuses used for various purposes other than printing image and the like. For example, it is also possible to apply the present teaching to liquid jet apparatuses which jet an electroconductive liquid to a substrate to form an electroconductive pattern on a surface of the substrate.

What is claimed is:

1. A liquid jet apparatus comprising:

a film;

a first piezoelectric element arranged on the film;

a second piezoelectric element arranged on the film;

a third piezoelectric element arranged on the film; and a trace connected with the first piezoelectric element, wherein the second piezoelectric element and the third piezoelectric element are aligned along a first direction, wherein the first piezoelectric element is offset from the second and the third piezoelectric elements in a second direction orthogonal to the first direction, wherein the first piezoelectric element includes a first piezoelectric portion, wherein the second piezoelectric element includes a second piezoelectric portion, wherein the third piezoelectric element includes a third piezoelectric portion, wherein the trace includes a first portion and a second portion which is offset from the first portion in the second direction, wherein the first portion is located between the film and the first piezoelectric portion in a third direction orthogonal to the first and second directions, wherein the second portion is located between the second piezoelectric portion and the third piezoelectric portion in the first direction, and wherein the second portion is covered with a metallic film.

2. The liquid jet apparatus according to claim 1, wherein the first piezoelectric portion is covered with an electrode.

3. The liquid jet apparatus according to claim 2, wherein the metallic film includes at least a layer, and wherein the layer is formed of the same material as the electrode.

4. The liquid jet apparatus according to claim 2, wherein the electrode is covered with a layered electrode.

5. The liquid jet apparatus according to claim 4, wherein the metallic film includes at least a layer, and wherein the layer is formed of the same material as the layered electrode.

6. The liquid jet apparatus according to claim 4, wherein the metallic film includes at least a first layer and a second layer, wherein the first layer is formed of the same material as the electrode, and wherein the second layer is formed of the same material as the layered electrode.

7. The liquid jet apparatus according to claim 1, wherein the trace is formed of platinum.

8. The liquid jet apparatus according to claim 1, wherein a part of the metallic film is arranged on a piezoelectric layer.

9. The liquid jet apparatus according to claim 8, wherein the first piezoelectric element is a first portion of the piezoelectric layer, wherein the second piezoelectric element is a second portion of the piezoelectric layer, and wherein the third piezoelectric element is a third portion of the piezoelectric layer.

* * * * *